US006624559B2

(12) United States Patent
Suzuki et al.

(10) Patent No.: US 6,624,559 B2
(45) Date of Patent: Sep. 23, 2003

(54) CATHODE RAY TUBE

(75) Inventors: Nobuyuki Suzuki, Ohhara (JP); Toshio Nakayama, Shirako (JP); Yasuo Tanaka, Ichihara (JP); Akiyoshi Tobe, Mobara (JP)

(73) Assignees: Hitachi Ltd, Tokyo (JP); Hitachi Electronic Devices, Tokyo (JP)

( * ) Notice: Subject to any disclaimer, the term of this patent is extended or adjusted under 35 U.S.C. 154(b) by 109 days.

(21) Appl. No.: 09/825,472

(22) Filed: Apr. 3, 2001

(65) Prior Publication Data

US 2002/0096988 A1 Jul. 25, 2002

(30) Foreign Application Priority Data

Jan. 19, 2001 (JP) ..... 2001-011537

(51) Int. Cl.[7] ..... H01J 29/50
(52) U.S. Cl. ..... 313/414; 315/3; 315/15
(58) Field of Search ..... 313/414, 412, 313/417, 421, 422, 426, 427; 315/3, 15, 381–2, 382.1

(56) References Cited

U.S. PATENT DOCUMENTS 5,146,133 A * 9/1992 Shirai et al. ..... 313/414
5,262,702 A * 11/1993 Shimoma et al. ..... 313/414
6,005,339 A * 12/1999 Misono ..... 313/413
6,031,326 A * 2/2000 Suzuki et al. ..... 313/414
6,051,919 A * 4/2000 Shirai et al. ..... 313/412
6,133,685 A 10/2000 Konda et al.
6,144,151 A * 11/2000 Tojo et al. ..... 313/409

FOREIGN PATENT DOCUMENTS

| | | |
|---|---|---|
| JP | 81738/1985 | 5/1985 |
| JP | 10-74465 | 3/1998 |
| JP | 10-33824 | 12/1998 |
| JP | 200188067 A | 4/2000 |

* cited by examiner

*Primary Examiner*—Sandra O'Shea
*Assistant Examiner*—Sumati Krishnan
(74) *Attorney, Agent, or Firm*—Milbank, Tweed, Hadley & McCloy LLP

(57) ABSTRACT

There is provided a cathode ray tube capable of displaying high quality images by suppressing eddy current from occurring and by realizing the velocity modulation. A cylindrical focusing electrode is divided into first cylindrical focusing electrode 4B and second cylindrical focusing electrode 4T and the gap between the both electrodes formed and divided by optimizing the length of the second cylindrical focusing electrode 4T in the tube axial direction is enlarged substantially to increase the infiltration of the velocity modulating magnetic field to the non-electric space of the focusing electrode 4. An electrode 4*a* having the equal potential with the focusing electrode 4 is disposed at the gap to suppress eddy current from being generated.

17 Claims, 7 Drawing Sheets

$\phi 5 \leqq \phi 6$

CATHODE RAY TUBE

BACKGROUND OF THE INVENTION

1. Field of the Invention

The present invention relates to a cathode ray tube whose velocity modulating effect is enhanced and more specifically to a cathode ray tube which enables to display high quality images having remarkable contrast by preventing the decrease of velocity modulating effect caused by eddy current caused by velocity modulating magnetic field generated in electrodes composing an electron gun.

2. Related Art

Various contrivances for displaying high definition and high contrast images have been made to improve the imaging quality of a cathode ray tube for displaying TV images and of a cathode ray tube of an information terminal such as a personal computer.

For instance, there has been known an aperture compensating method of stressing white components by a signal obtained by differentiating an image signal to clearly display outlines. However, this method has had drawbacks that there is a case when it deteriorates image quality in contrary by generating unnecessary white peaks and deteriorating the contrast and that only the right side (downstream side of the horizontal scan direction) of the contrast boundary of an image can be always corrected.

There has been also a velocity modulation of changing electron beam scanning velocity corresponding to the brightness level of an image. This method is to control the scan of an electron beam. The scan of electron beam stop momently after quickening the scanning velocity momently when the electron beam scans horizontally from the black level to the white level by the differential output of the image signal. The scan of electoron beam quicken momently after stopping the scan momently when the electron beam scans horizontally from the white level to the black level.

The density of electron beam is low and the image is dark at the spot where the scan rate is fast. The density of electron beam is high and the image is bright at the spot where the scan stops. Thereby, a high contrast and good quality image is displayed by increasing the black level areas, by narrowing the white level area and by increasing the brightness by increasing the current density.

While there are electrostatic and electromagnetic type velocity modulations, a cathode ray tube using the electromagnetic type velocity modulation which has been currently widely adopted will be explained below.

FIG. 13 is a diagrammatic sectional view for explaining a structural example of the main part of the cathode ray tube which adopts the conventional electromagnetic type velocity modulation and which comprises a cathode K, a first electrode 1 (control electrode), a second electrode 2 (first accelerating electrode), a third electrode 3 (second accelerating electrode), a fourth electrode 4 (focusing electrode) and a fifth electrode 5 (anode electrode).

The cathode ray tube has a panel portion (not shown) having a phosphor screen and a vacuum envelope comprising a funnel portion 22 and a neck portion 23. An electron gun is housed within the neck portion 23 and a deflecting yoke 30 is externally mounted around the transition area between the neck portion 23 and the funnel portion 22.

The cathode ray tube also has a convergence regulating and color purity regulating correcting magnetic device 31 externally mounted at the neck portion 23 where the electron gun is housed at the position leaning toward the cathode side from the position where the deflecting yoke 30 is externally mounted and a velocity modulating coil 32 externally mounted at the neck portion 23 at the position leaning toward the cathode side from the position where the correcting magnetic device 31 is externally mounted.

The fourth electrode 4, i.e., the focusing electrode, is a relatively deep (long in the tube axial direction) cylindrical electrode as a whole and its inside is an almost equipotential space. Positive (scan direction) or negative (reverse direction from the scan direction) deflection in the horizontal scan direction acts momentarily on the electron beam passing through the fourth electrode 4 by a magnetic field caused by current flowing through the velocity modulating coil 32.

The direction of the positive deflection is the same with the horizontal deflecting direction caused by the deflecting yoke 30, so that the horizontal scan velocity of the electron beam on the screen becomes fast. The direction of the negative deflection is opposite from the horizontal deflecting direction caused by the deflecting yoke 30, so that the velocity of the electron beam on the screen becomes almost zero, thus enhancing the contrast and improving the image quality as described above.

While the velocity modulating coil 32 is mounted at any place on the way where the electron beam passes in principle, it must be mounted at the place distant from the deflecting yoke 30 by a predetermined distance so that no interference occurs with it.

Accordingly, the velocity modulating coil 32 cannot but be mounted at the place toward the cathode K rather than the fourth electrode 4, i.e., the focusing electrode. Ideally, it is disposed at the outer periphery of the fourth electrode 4 composing the focusing electrode as shown in FIG. 13.

However, because the relatively large convergence regulating and purity regulating correcting magnetic device 31 is attached to the outside of the neck portion where the fourth electrode 4 is located from the relationship of disposition of the parts at the neck portion, the velocity modulating coil 32 is attached to the position leaned toward the third electrode 3 rather than the fourth electrode 4.

Because frequency of current flowing the velocity modulating coil 32 is high and the fourth electrode 4 is made of non-magnetic metallic material such as stainless steel similarly to the other electrodes, eddy current is generated within the electrode when magnetic field acts on it from the velocity modulating coil 32.

The eddy current suppresses the magnetic flux acting on the space of the fourth electrode 4 and diminishes the velocity modulating effect.

FIG. 14 is a sectional view for explaining one structural example of a conventional electron gun. The same reference numerals therein denote the same or corresponding parts in FIG. 13. The fourth electrode (focusing electrode) 4 is divided into a first cylindrical focusing electrode 4B (fourth bottom electrode) and a second cylindrical focusing electrode 4T (fourth top electrode) in the tube axial direction.

The first cylindrical focusing electrode 4B(fourth bottom electrode) is electrically connected with the second cylindrical focusing electrode 4T(fourth top electrode) by a connecting line 7 disposed at the outside of the respective electrodes so as to have equal potential. It is noted that the third electrode 3 and the fifth electrode 5 have the equal potential, focusing voltage Vf is applied to the first cylindrical focusing electrode 4B and they are electrically connected by connectors 8, respectively.

The reference numerals 1*t*, 2*t*, 3*t*, 4*t*–1, 4*t*–2 and 5*t* are electrode supports (bead supports) for embedding and fixing the first electrode 1, the second electrode 2, the third electrode 3, the first cylindrical focusing electrode 4B, the second cylindrical focusing electrode 4T and the fifth electrode 5 to an insulating support (bead glass) 6, respectively.

The electron gun shown in the figure is a so-called large aperture single electron gun used for a projection type cathode ray tube in particular and has a large diameter portion 4F at the edge region of the second cylindrical focusing electrode 4T of the fourth electrode 4. The large diameter portion 4F is inserted to the inside of the fifth electrode 5, i.e., the anode electrode. It is noted that the cathode is not shown in the figure.

Since focusing electrode have a gap between the first cylindrical focusing electrode 4B and the second cylindrical focusing electrode 4T as shown in FIG. 14, the magnetic field from the velocity modulating coil acts directly on the electron beam.

Such arrangement allows the efficient velocity modulation to be realized by executing the velocity modulation by causing the magnetic field to enter the space of the fourth electrode 4.

Publications disclosing the prior art related to such cathode ray tube include Japanese Patent Laid-Open No. 334824/1998, 74465/1998, and 188067/2000 and Patent Publication No. 21216/1987 for example.

However, the related art cathode ray tube in which the focusing electrode is divided in the tube axial direction has had a problem that the entrance of the velocity modulating magnetic field is not enough because there is a limit in expanding the gap. That is, the influence of electric field from the bead glass and the connector becomes large if the gap between the divided electrodes is too large.

The related art cathode ray tube in which the part of the focusing electrode is coiled also has had a problem that the focusing electrode deforms, thus distorting the shape of spot of the electron beam.

Still more, no consideration is taken about the length of the divided focusing electrode in the tube axial direction in the related art cathode ray tube.

SUMMARY OF THE INVENTION

Accordingly, the invention provide a cathode ray tube comprising an electron gun which is capable of displaying high quality images by arranging the focusing electrode for modulating velocity.

The inventive cathode ray tube comprises a vacuum envelope comprising a panel portion forming a phosphor screen, a neck portion storing an electron gun and a funnel portion connecting the panel portion and the neck portion; a deflecting yoke externally mounted at the transition area of the funnel portion and the neck portion.

In the cathode ray tube, the electron gun has a plurality of electrodes including a cathode, a control electrode, an accelerating electrode, a focusing electrode and an anode electrode at predetermined intervals in the tube axial direction; the focusing electrode is composed of a first cylindrical focusing electrode which is disposed on the cathode side, a second cylindrical focusing electrode which is disposed on the phosphor screen side and at least one plate electrode or ringed electrode which is disposed between the first cylindrical focusing electrode and the second cylindrical focusing electrode; and the first and second cylindrical focusing electrodes and the plate electrode or ringed electrode are connected at equal potential by connecting line.

This arrangement also allows eddy current generated in the electrode by the magnetic field generated by the velocity modulating coil to be reduced and the magnetic field from the velocity modulating coil to readily enter to the space of the focusing electrode. Thereby, it becomes possible to obtain the full velocity modulating effect, to improve the contrast of images and to display high quality images.

DESCRIPTION OF THE PREFERRED EMBODIMENTS

Preferred embodiments of the invention will be explained in detail below with reference to the drawings.

Figure 1:
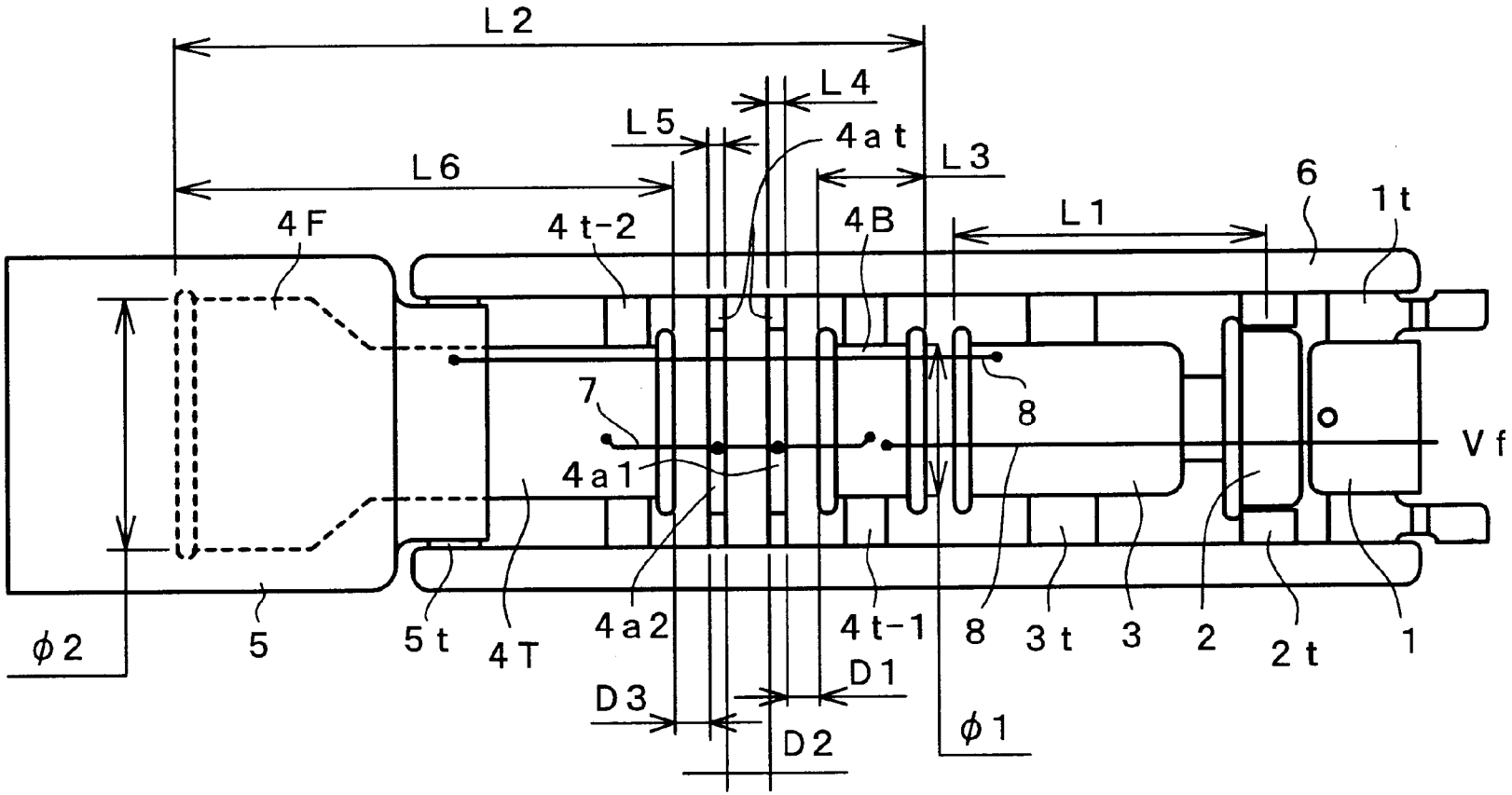
FIG. 1 is a side view of an electron gun according to a first embodiment of an inventive cathode ray tube.

FIG. 1 is an illustration for explaining an electron gun according to a first embodiment of an inventive cathode ray tube. The electron gun comprises a cathode, a first electrode 1, a second electrode 2, a third electrode 3, a focusing electrode 4 (composed of a first cylindrical focusing electrode 4B and a second cylindrical focusing electrode 4T) and an anode electrode 5. These electrodes are fixed by insulating supports (bead glass or beading glass) in this order at predetermined intervals. The electrodes have bead supports 1*t*, 2*t*, 3*t*, 4*t*–1, 4*t*–2 and 5*t* for embedding to the insulating support by the outer wall or outer edge thereof.

In FIG. 1, a so-called triode portion (electron beam generating portion) is composed of the cathode, the first electrode 1 and the second electrode 2. The fifth electrode 5 is a large diameter electrode. A large diameter portion 4F of the second cylindrical focusing electrode 4T of the fourth electrode is inserted to the inside of the fifth electrode 5. A main lens is formed between the anode electrode 5 and the large diameter portion 4F of the fourth electrode within the fifth electrode 5 which is the anode electrode. It is noted that the third electrode 3 and the fifth electrode 5 have equal potential and are electrically connected by a connector 8.

In the present embodiment, two plate electrodes 4*a* formed an opening for passing an electron beam are provided between a first cylindrical fourth electrode 4B and a second cylindrical focusing electrode 4T which are the small diameter part of the focusing electrode 4.

The length of the first cylindrical focusing electrode 4B positioned on the cathode side in the tube axial direction is shorter than that of the related art divided electrode. It is possible to cause the velocity modulating magnetic field to act efficiently at a area of enlarged electron beam diameter area by an accelerating lens formed between the third electrode 3 and the focusing electrode by setting the lower limit of the length at least at 4 mm.

Figure 2A:
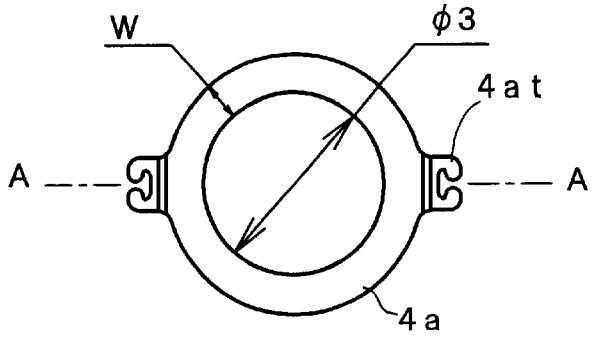
FIG. 2A is a front view of a plate electrode.
Figure 2B:
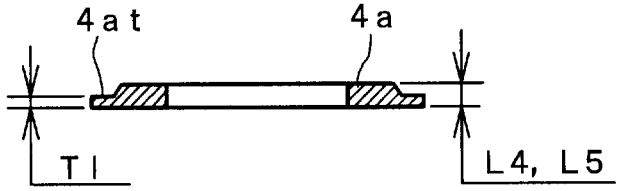
FIG. 2B is a sectional view of plate electrode along a line A–A in FIG. 2A.

FIGS. 2A and 2B are illustrations for explaining the plate electrodes in FIG. 1, wherein FIG. 2A is a front view and FIG. 2B is a sectional view along a line A–A in FIG. 2A. The diameter Φ3 of the opening created through the plate electrode 4*a* is at least equal to or more than the inner diameter of the focusing electrode 4 (inner diameter of the part where the first cylindrical focusing electrode 4B faces with the second cylindrical focusing electrode 4T=inner diameter ϕ1 of the third electrode 3). The inner diameter ϕ2 of the large diameter portion of the second cylindrical focusing electrode 4T is the size not contacting with the inner wall of the anode electrode 5.

The plate electrode 4*a* is formed by punching a plate while leaving the circumferential width W and a bead support 4*at*. In FIG. 2A, the plate electrode has disc-like form. That is, the bead support 4*at* is formed in a body at the outer periphery of the disc electrode 4*a*. the bead support 4 is embedded to an insulating support 6 to fix the disc electrode 4*a*. It is preferable to set the thickness of the plate T1 of the bead support 4*at* to be thinner than the thickness L4 (L5) of the disc electrode 4*a* so as to avoid cracks or the like of the insulating support 6 when it is embedded to the insulating support 6.

The following is the concrete dimension of the electron gun arranged as shown in the present embodiment and denoted by the reference numerals in FIGS. 1 and 2:

L1: Whole length of the third electrode 3 in the tube axial direction=20.5 mm L2: Whole length of the fourth electrode 4 (focusing electrode) in the tube axial direction=48.7 mm L3: Length of the first cylindrical focusing electrode 4B of the fourth electrode 4 in the tube axial direction=6.7 mm L4=L5: Thickness (length in the tube axial direction) of the disc electrode 4*a* (4*a*l, 4*a*2)=1 mm L6: Length of the second cylindrical focusing electrode 4T of the fourth electrode 4 in the tube axial direction= 34 mm ϕ1: Inner diameter of the third electrode 3=Inner diameter of the small diameter part of the fourth electrode 4=9.9 mm ϕ2: Inner diameter of the large diameter part of the second cylindrical focusing electrode 4T of the fourth electrode 4=15.8 mm ϕ3: Inner diameter of the disc electrode 4*a* (4*a*1, 4*a*2)= Inner diameter of the third electrode 3 =Inner diameter of the small diameter part of the fourth electrode 4=9.9 mm D1: Gap between the first cylindrical focusing electrode 4B and the disc electrode 4*a*1=2 mm D2: Gap between the disc electrode 4*a*1 and the disc electrode 4*a*2=2 mm D3: Gap between the disc electrode 4*a*2 and the second cylindrical focusing electrode 4T=2 mm The magnetic field generated by the velocity modulating coil enters efficiently to the space of the fourth electrode 4 (focusing electrode) by the cathode ray tube using the electron gun as constructed in the present embodiment.

The electron beam passage the fourth electrode 4 is accelerated and its diameter is enlarged by the lens formed in the area where the third electrode 3 faces to the first cylindrical focusing electrode 4B. Accordingly, the velocity modulating efficiency of the velocity modulating magnetic field acts on such electron beam effectively.

Thus, the present embodiment enables to obtain the full velocity modulating effect as the magnetic field from the velocity modulating coil may readily enter to the focusing electrode 4 and the eddy current generated in the focusing electrode 4 is reduced. Then, the influence of electrical field generated by the bead glass and the connector is decreased, the contrast of the image is improved and the high quality image is displayed.

Figure 3:
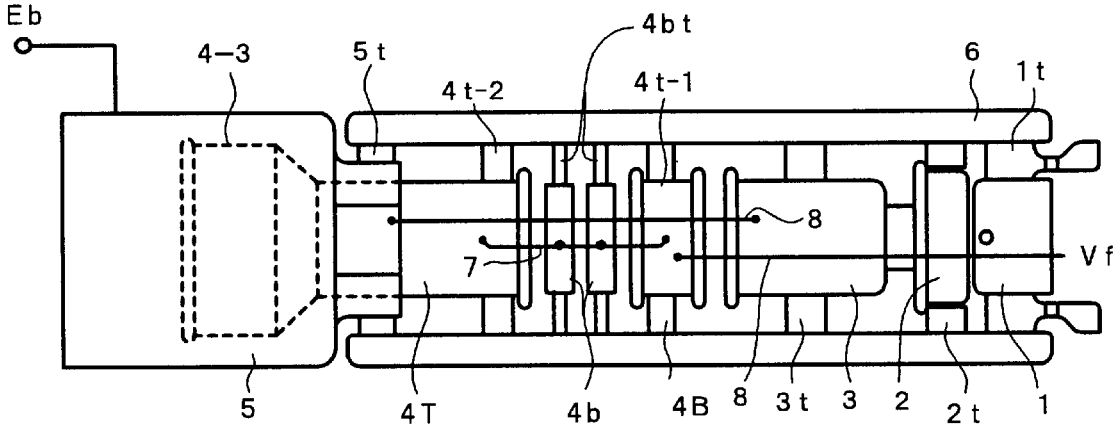
FIG. 3 is a side view of an electron gun according to a inventive cathode ray tube.

FIG. 3 is an illustration for explaining an electron gun according to a second embodiment of the inventive cathode ray tube. This electron gun is characterized in that ringed electrodes 4*b* are provided between the first cylindrical focusing electrode 4B and the second cylindrical focusing electrode 4T composing the fourth electrode 4, instead of the disc electrode in the first embodiment explained in FIG. 1. The other components are the same with those in FIG. 1.

The focusing electrode 4 of the present embodiment is divided into the first cylindrical focusing electrode 4B at the cathode side and the second cylindrical focusing electrode 4T at the phosphor screen side and the two ringed electrodes 4*b* are provided between the first cylindrical focusing electrode 4B and the second cylindrical focusing electrode 4T.

Figure 4A:
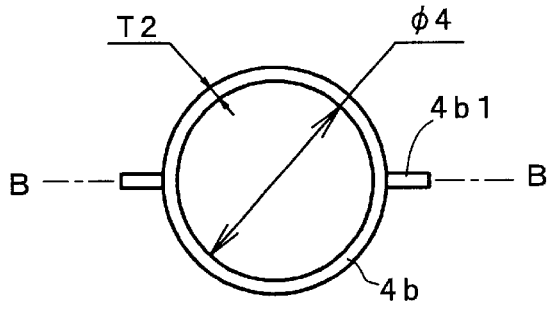
FIG. 4A is a front view of a ringed electrode according to a second embodiment of an inventive cathode ray tube.
Figure 4B:
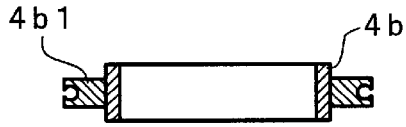
FIG. 4B is a sectional view of a ringed electrode along a line B–B in FIG. 4A.

FIGS. 4A and 4B are illustrations for explaining a ringed electrode composing the electron gun shown in FIG. 3, wherein FIG. 4A is a front view and FIG. 4B is a sectional view along a line B–B in FIG. 4A. The ringed electrode 4*b* has a thickness of T2 and has a shape in which the length of a cylindrical electrode similar to the focusing electrode 4 in the tube axial direction is shortened and the diameter of an opening ϕ4 where the electron beam passes is at least equal to or greater than the inner diameter of the fourth electrode (the inner diameter of the part where the first cylindrical focusing electrode 4B faces to the second cylindrical focusing electrode 4T=inner diameter ϕ1 of the third electrode 3).

An electrode support, i.e., a bead support 4*bt*, is attached to the outer periphery of the ringed electrode 4*b* of the present embodiment to embed to the insulating support 6 to fix the ringed electrode 4*b*. It is noted that instead of the bead support 4*bt*, the same one with the bead support formed for the disc electrode explained in FIG. 2 is used.

The magnetic field generated by the velocity modulating coil enters efficiently to the space of the fourth electrode 4 (focusing electrode) and the efficient velocity modulation is realized by reducing the eddy current generated in the fourth electrode 4 also in the cathode ray tube using the electron gun arranged as described in the present embodiment.

The electron beam passing through the fourth electrode 4, i.e., the focusing electrode, is accelerated and its beam diameter is enlarged by the lens formed at the area where the third electrode 3 faces to the first cylindrical focusing electrode 4B. Accordingly, the velocity modulating effect by the velocity modulating magnetic field acts on the electron beam effectively.

Thus, similarly to the embodiment described above, the present embodiment enables to obtain the full velocity modulating effect as the magnetic field from the velocity modulating coil may readily enter to the space of the focusing electrode 4 and the eddy current generated in the focusing electrode 4 is reduced. Then, the contrast of the image is improved and the high quality image is displayed.

Figure 5A:
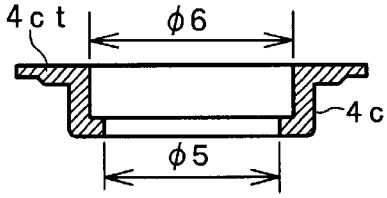
FIG. 5A is a sectional view of ringed electrode according to a third embodiment of an inventive cathode ray tube.
Figure 5B:
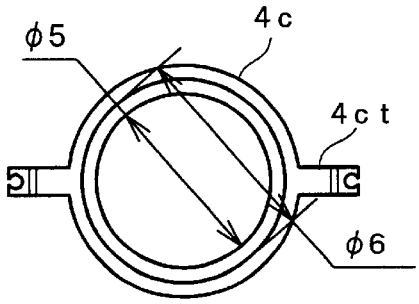
FIG. 5B is a front view of ringed electrode.

FIGS. 5A and 5B are illustrations for explaining a third embodiment of the inventive cathode ray tube and correspond to a modified example of the ringed electrode 4*b* explained in FIG. 4. That is, FIGS. 5A and 5B show a cup-like electrode used instead of the ringed electrode 4*b* explained in FIG. 4.

According to the present embodiment, the cup-like electrode 4*c* is provided, instead of the ringed electrode 4*b* explained in FIG. 4, between the first cylindrical electrode 4*b* and the second cylindrical focusing electrode 4T composing the fourth electrode 4 in the electron gun shown in FIG. 3. The other components are the same with those explained in FIG. 3.

The cup-like electrode 4*c* of the present embodiment is formed by punching the cup-like part and the bead support part in a body. Accordingly, a number of parts is lessened as compared to the ringed electrode 4*b* shown in FIG. 4, thus contributing to the simplification of the assembly and to the reduction of the cost. The cup-like electrode 4*c* shown in FIGS. 5A and 5B has a short cylinder whose one opening is smaller than the other opening more or less. That is, the inner diameter $\phi$5 of one opening is smaller than the inner diameter $\phi$6 of the other opening in the figure. However, there is no problem even if $\phi$5=$\phi$6. Other effect of the present embodiment is the same with those embodiments described above.

Figure 6:
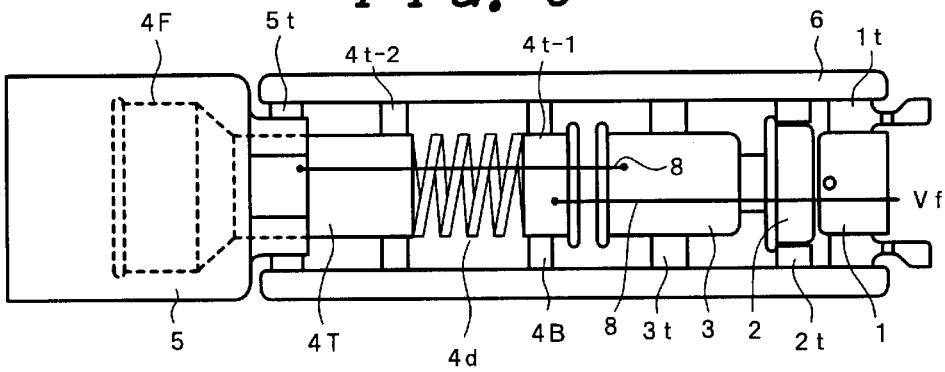
FIG. 6 is a side view of an electron gun of a fourth embodiment of the inventive cathode ray tube.
Figure 7:
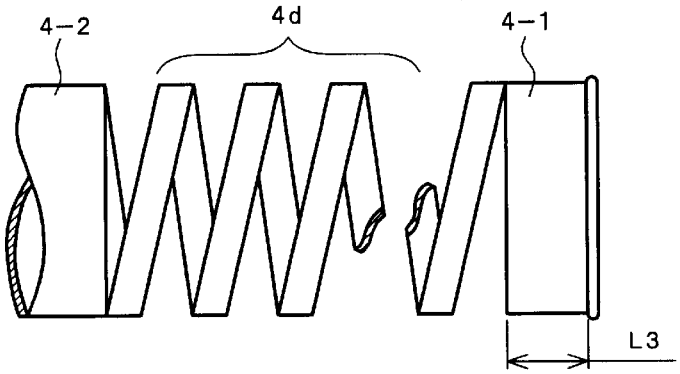
FIG. 7 is an enlarge view of the main part of the electron gun shown in FIG. 6.

FIG. 6 is an illustration for explaining an electron gun of a fourth embodiment of the inventive cathode ray tube and FIG. 7 is an enlarge view of the main part of the electron gun shown in FIG. 6. The fourth electrode 4 comprise the first cylindrical focusing electrode 4B and the second cylindrical focusing electrode 4T. The first cylindrical focusing electrode 4B and the second cylindrical focusing electrode 4T are electrically connected by a spiral connecting line 4*d* surrounding the electron beam passage. The inner diameter of the spiral connecting line 4*d* is equal to or greater than the inner diameter of the part where the first cylindrical focusing electrode 4B opposite to the second cylindrical focusing electrode 4T.

The length of the first cylindrical focusing electrode 4B positioned on the cathode side in the tube axial direction is shorter than that of the related art divided electrode. It is possible to cause the velocity modulating magnetic field to act efficiently at a area of enlarged electron beam diameter area by an accelerating lens formed between the third electrode 3 and the focusing electrode by setting the lower limit of the length at least at 4 mm. Other components are the same with those in FIG. 1 or 3.

The spiral connecting line 4*d* is formed by working the intermediate region of the focusing electrode 4 leaned toward the cathode side as shown in FIG. 7. The spiral connecting line 4*d* is created as a separate part and is welded to the first cylindrical focusing electrode 4B and the second cylindrical focusing electrode 4T.

The magnetic field generated by the velocity modulating coil enters to the internal space of the fourth electrode 4 (focusing electrode) efficiently from the gap of the spiral connecting line 4*d* also in the cathode ray tube using the electron gun constructed as described in the present embodiment. The spiral conecting line block the influence of a electrical field formed by the bead glass and the connector 8.

The electron beam passing through the fourth electrode 4 is accelerated and its beam diameter is enlarged by the electron lens formed the third electrode 3 and the first cylindrical focusing electrode 4B. Accordingly, the velocity modulating effect by the velocity modulating magnetic field acts on the electron beam effectively.

Thus, the present embodiment enables to obtain the full velocity modulating effect as the magnetic field from the velocity modulating coil may readily enter to the space of the focusing electrode 4 and the eddy current generated in the focusing electrode 4 is reduced. Then, the contrast of the image is improved and the high quality image is displayed.

Figure 8:
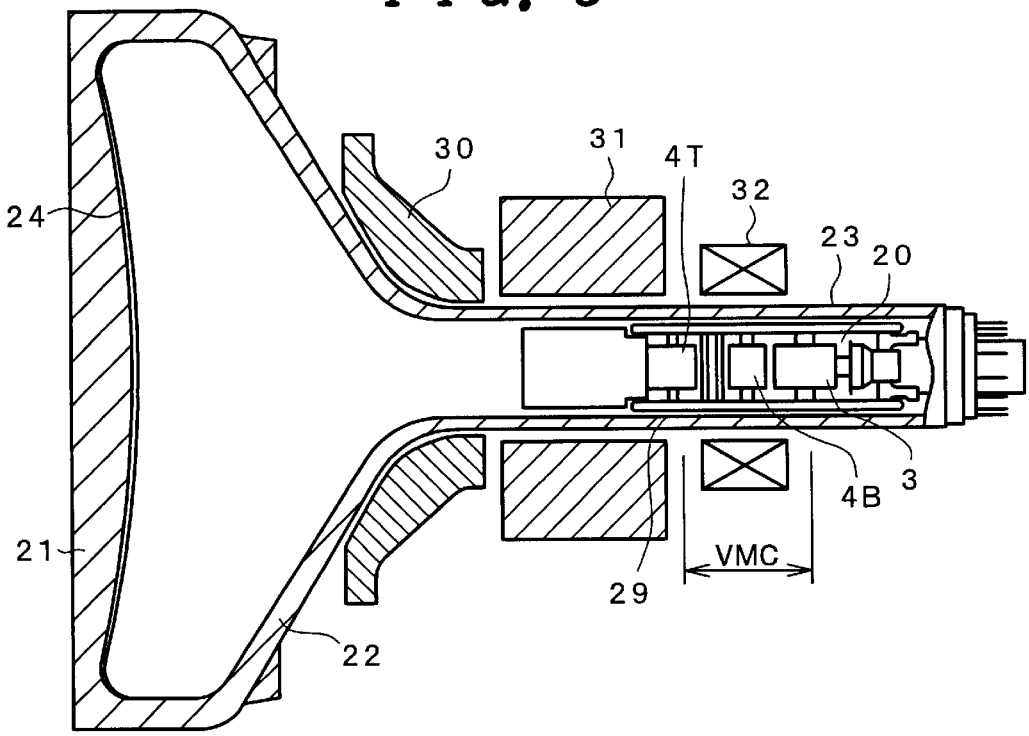
FIG. 8 is a diagrammatic sectional view for explaining the whole structural example of the inventive cathode ray tube.

FIG. 8 is a diagrammatic sectional view for explaining the structural example of the inventive cathode ray tube. This is a monochrome projection type cathode ray tube. A projection color TV set use three similar projection type cathode ray tubes.

This cathode ray tube has a vacuum envelope composed of a panel portion 21, a funnel portion 22 and a neck portion 23 and a phosphor screen 24 made of monochrome phosphor material at the inner surface of the panel portion 21. The electron gun 20 emitting one electron beam is housed within the neck portion 23 and the deflection yoke 30 is externally mounted at the transition area of the neck portion 23 and the funnel portion 22.

A convergence regulating and purity regulating correcting magnetic device 31 and the velocity modulating coil 32 are mounted at the outer periphery of the neck portion 23 where the electron gun 20 is housed. The correcting magnetic device 31 is positioned at the cathode side from the deflection yoke 30 and at the phosphor screen side from the velocity modulating coil 32. The area dominated by the correcting magnetic device 31 on the neck portion is relatively large. Therefore, the velocity modulating coil 32 cannot but be provided at the third electrode 3 side rather than the focusing electrode 4.

The two disc electrodes 4*a* (4*a*1, 4*a*2) are provided in the gap between the first cylindrical focusing electrode 4B and the second cylindrical focusing electrode 4T as explained in FIGS. 1 and 2. The velocity modulating coil 32 is positioned at the area VMC from the gap of the focusing electrode 4 where these two disc electrodes 4*a* (4*a*1, 4*a*2) are provided to the gap between the third electrode 3 and the first cylindrical focusing electrode 4B. An image reproducing apparatus using this cathode ray tube will be described later.

Figure 9:
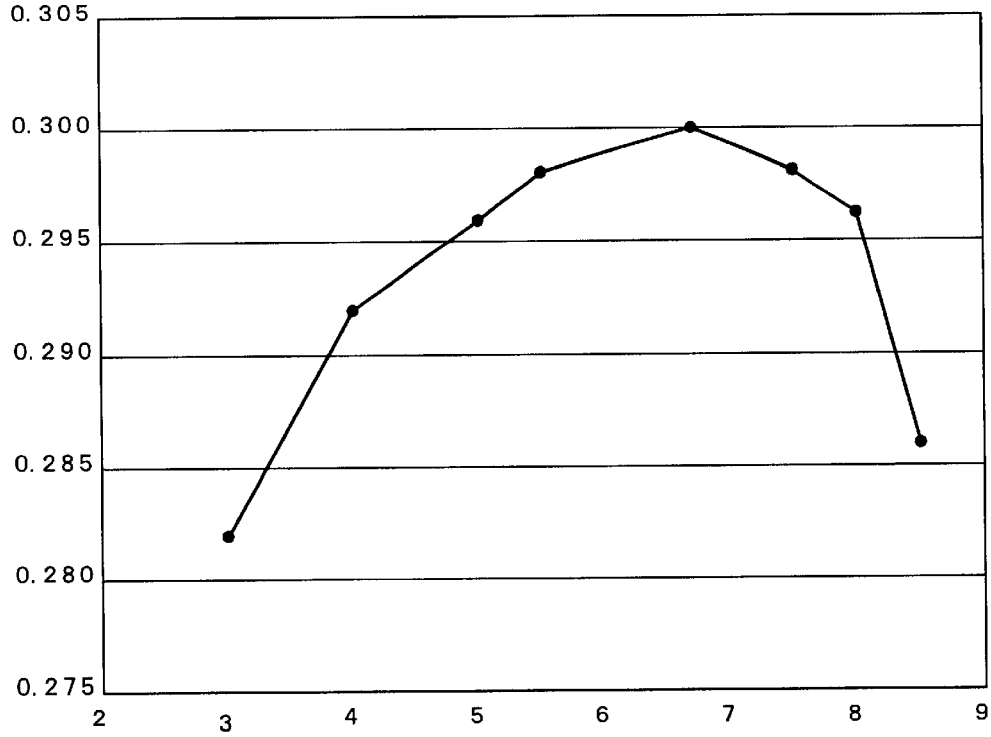
FIG. 9 is a graph for explaining the changes of velocity modulating sensitivity to the length of a first cylindrical focusing electrode in the tube axial direction.

FIG. 9 is a graph for explaining changes of velocity modulating sensitivity with respect to the length of the first cylindrical focusing electrode in the tube axial direction in each embodiment of the invention. Here, a case when the inner diameter of the focusing electrode is set at 9.9 mm will be shown.

In FIG. 9, the G4 bottom length in the abscissa indicates the length of the first cylindrical focusing electrode (the electrode denoted by the reference numeral 4B in FIG. 1 for example) by 'mm' and the ordinate indicates movement (beam movement) of a beam spot on the phosphor screen when modulation current to the velocity modulating coil is turned on/off (on=when velocity modulation is applied and off =no velocity modulation is applied) by 'mm'.

The focusing electrode of the electron gun is divided into the first cylindrical focusing electrode 4B and the second cylindrical focusing electrode 4T in each embodiment of the invention. The graph is what the velocity modulating sensitivity is plotted when the length in the tube axial direction of the first cylindrical focusing electrode 4B (=G4 bottom) which is the cylindrical electrode positioned at the cathode side is changed from 3 mm to 8.5 mm.

As shown in the graph, the length in the tube axial direction of the first cylindrical focusing electrode 4B (=G4 bottom) is 4 mm to 8 mm and the magnitude of the velocity modulating sensitivity recognized as the moving distance on the phosphor screen is around 0.3 mm in maximum. The moving distance of the beam spot of around 0.3 mm on the phosphor screen when the modulation current to the velocity modulating coil is turned on/off is the size recognizable. The moving distance of the beam spot on the screen is about 10 times of that on the phosphor screen. For instance, when the moving distance of the beam spot on the phosphor screen is 0.3 mm, the moving distance of the beam spot on the screen is about 3 mm. The improvement of the contrast of the image is recognized by flowing current to the velocity modulating coil. This is verified by sensual tests in this technological field.

From this fact, the length of the first cylindrical focusing electrode in the tube axial direction is between 4 mm to 8 mm in the invention.

When the length of the first cylindrical focusing electrode is smaller than 4 mm or greater than 8 mm, the inclination of the line in the graph becomes large as shown in FIG. 9. It means that the beam movement fluctuates largely due to changes the length of the first cylindrical focusing electrode in the tube axial direction.

According to the invention, since the length of the first cylindrical focusing electrode is from 4 mm to 8 mm, the beam movement is increas. Still more, this invention allows productive dispersion. This invention realize velocity modulating effect even if the productive dispersion of the length of the first cylindrical focusing electrode 4B in the tube axial direction is large.

Figure 10:
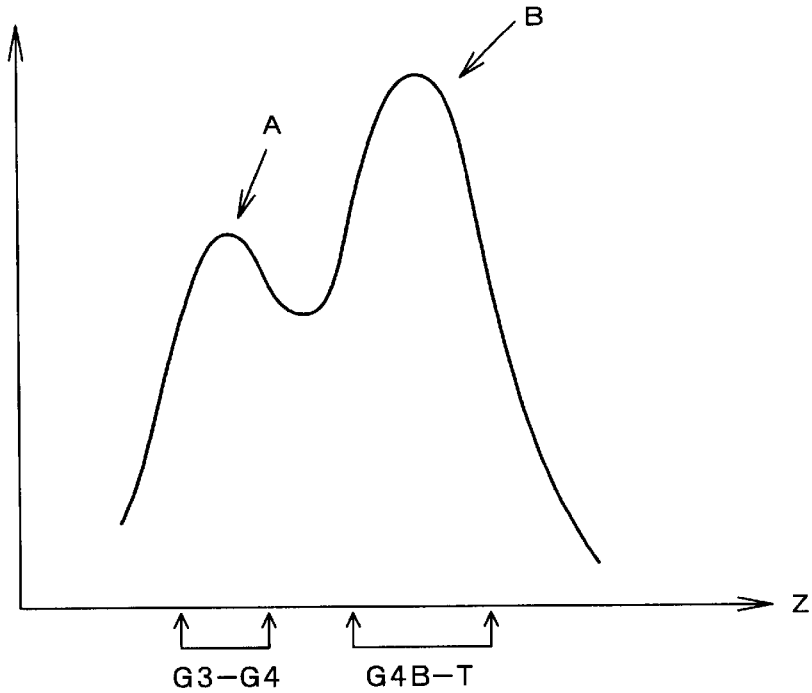
FIG. 10 is a qualitative graph of the velocity modulating sensitivity of the inventive cathode ray tube.

FIG. 10 is a qualitative graph of the velocity modulating sensitivity of the inventive cathode ray tube. The horizontal axis represents the position of the cathode ray tube in the tube axial direction and the vertical axis represents relative values of the VM sensitivity (flux density near the tube axis). The velocity modulating effect is the total effect of the velocity modulating effect obtained by the magnetic field infiltrating to the gap between the first cylindrical focusing electrode 4B and the second cylindrical focusing electrode 4T of the divided focusing electrode 4 and of the velocity modulating effect obtained by the magnetic field infiltrating to the gap between the third electrode 3 and the first cylindrical focusing electrode 4B.

A first peak A composing the curve indicating the velocity modulating sensitivity in FIG. 10 is a velocity modulation component caused by the magnetic field infiltrating to the gap (G3–G4) between the third electrode 3 and the first cylindrical focusing electrode 4B and a second peak B is a velocity modulation component caused by the magnetic field infiltrating to the gap ($G4_{B-T}$) between the first cylindrical focusing electrode 4B and the second cylindrical focusing electrode 4T of the focusing electrode 4.

The position where the velocity modulating coil is mounted is the area including the gap ($G4_{B-T}$) between the first cylindrical focusing electrode 4B and the second cylindrical focusing electrode 4T of the focusing electrode 4 and the gap (G3–G4) between the third electrode 3 and the first cylindrical focusing electrode 4B because the various magnetic devices externally mounted to the neck portion of the cathode ray tube occupy the spaces.

Therefore, the magnetic field from the velocity modulating coil acts on the electron beam at the two gaps described above. The velocity modulating effect becomes large at the part where the velocity of the electron beam is large and at the part where the electron beam flux is enlarged. Therefore, the velocity modulating sensitivity shows the characteristics as shown in FIG. 10.

The arrangement of the present embodiment allows the required velocity modulation to be realized as the magnetic field generated by the velocity modulating coil reaches to the space of the fourth electrode (focusing electrode) by getting into the disc electrode 4*a*, the ringed electrode 4*b*, the cup-like electrode 4*c* or the spiral connecting line 4*d*. In the same time, the magnetic field generated by the velocity modulating coil reduces the eddy current generated in the fourth electrode 4 and suppresses the diminishment of the velocity modulating effect.

It allows the contrast of images displayed on the phosphor screen to be improved and the high quality images to be obtained.

Figure 11:
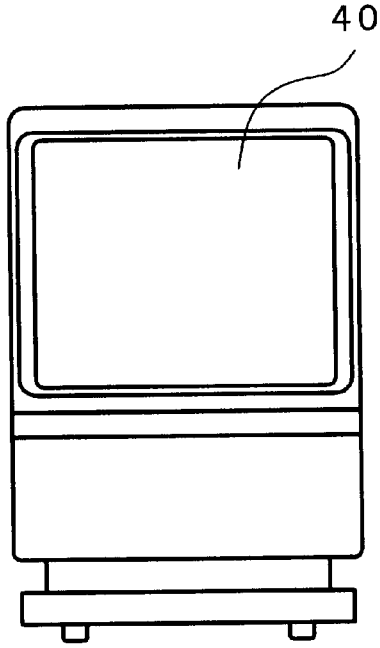
FIG. 11 is a front view of a projection type TV receiver as one example of an image display using the cathode ray tube shown in FIG. 8.
Figure 12:
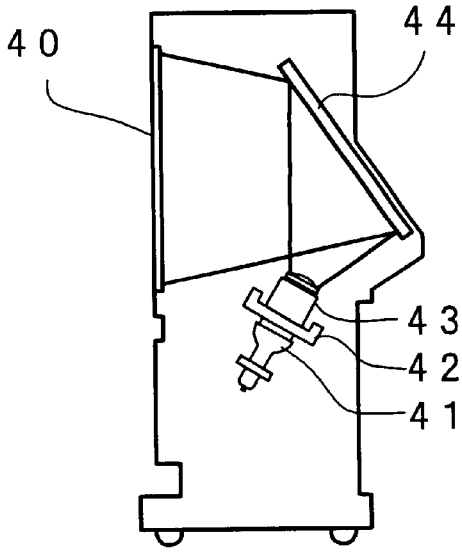
FIG. 12 is a side view diagrammatically showing the internal structure of the projection type TV receiver shown in FIG. 11.
Figure 13:
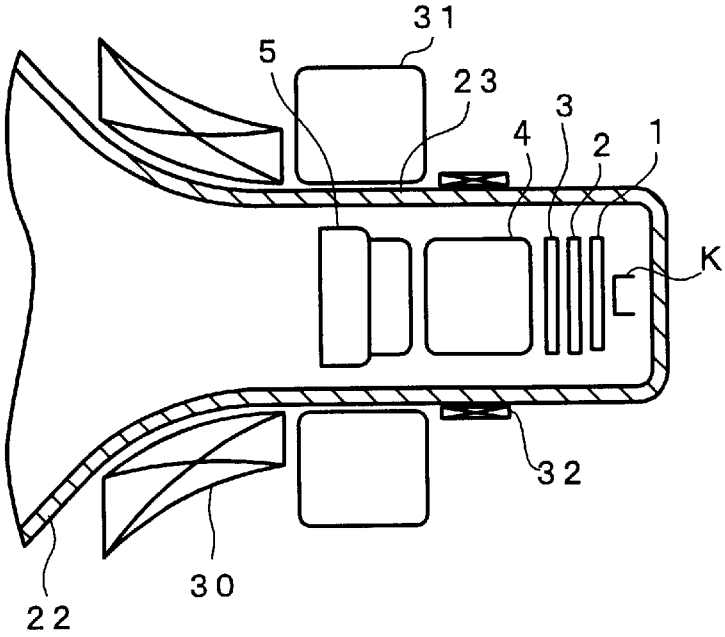
FIG. 13 (Prior Art)
FIG. 13 is a diagrammatic sectional view for explaining a structural example of the main part of a cathode ray tube which adopts a conventional electromagnetic type velocity modulation.
Figure 14:
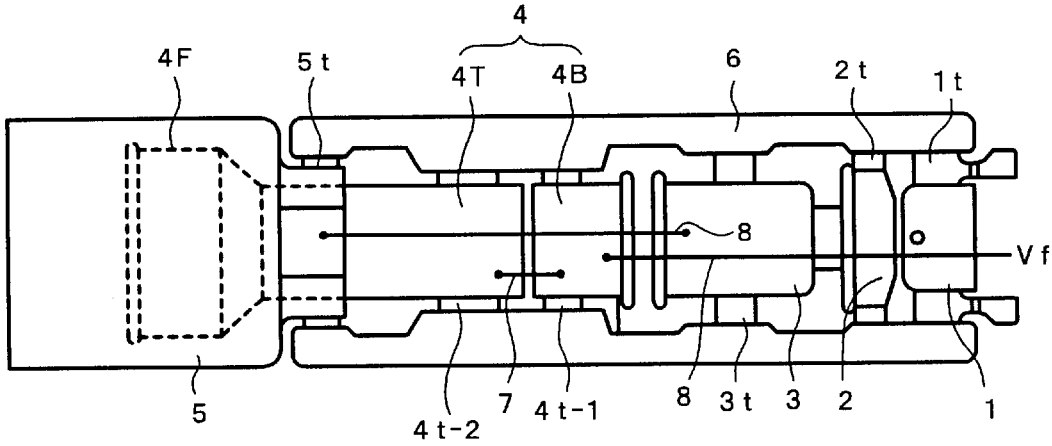
FIG. 14 (Prior Art)
FIG. 14 is a sectional view for explaining one structural example of an electron gun of the conventional velocity modulation.

FIG. 11 is a front view of a projection type TV receiver as one example of an image display using the cathode ray tube shown in FIG. 8 and FIG. 12 is a side view diagrammatically showing the internal structure of the projection type TV receiver shown in FIG. 11. The TV receiver comprises a screen 40, a cathode ray tube (projection type cathode ray tube) 41, an optical connector 42, a projecting optical system 43 and a mirror 44.

In the projection type TV receiver, the projecting optical system 43 provided at the panel portion via the connector 42 enlarges an image formed on the phosphor screen applied to a panel portion of the cathode ray tube 41 to project to the screen 40 via the mirror 44.

Such projection type TV receiver can reproduce images of a large screen of 40 inch type for example with high quality.

The invention is applied not only to the monochrome cathode ray tube described above but also to a direct vision type color cathode ray tube having a plurality of electron beams and a plurality of phosphor screens and to other various cathode ray tubes.

As described above, the invention can provide the cathode ray tube having the high image quality which can remarkably reduce the eddy current generated at the focusing electrode by the magnetic field generated by the velocity modulating coil, which enables the magnetic field from the velocity modulating coil to enter readily to the space of the electrode from the gap between the divided focusing electrodes and which allows the full velocity modulating effect.

In this invention, a cylindrical focusing electrode is divided into first and second cylindrical focusing electrodes to prevent eddy current from being generated and the gap between the divided electrodes is substantially enlarged to increase infiltration of velocity modulating magnetic field, to prevent the influence of deflecting magnetic field and others and to prevent deformation of the divided electrodes.

The length of the first cylindrical focusing electrode positioned on the cathode side in the tube axial direction is shortened as compared to the conventional divided electrodes.

That is, the focusing electrode is composed of the cylindrical electrodes where the electron beam emitted from the cathode passes and of at least one disc electrode having an opening where the electron beam passes. They are electrically connected by connecting lines disposed on the outside of the cylindrical electrodes and the disc electrode so as to equalize their potential.

The same effects with those described above is obtained by disposing at least one ringed electrode, instead of the disc electrode, between the first cylindrical focusing electrode and the second cylindrical focusing electrode.

The same effects with those described above is also obtained by electrically connecting the first cylindrical focusing electrode and the second cylindrical focusing electrode by a spiral connecting line surrounding the passage of the electron beam so as to equalize their potential instead of disposing the disc electrode and the ringed electrode between the first cylindrical focusing electrode and the second cylindrical focusing electrode.

The invention is not only limited to the electron gun of the projection type cathode ray tube adopting the velocity modulation in particular and allows the effect of suppressing the eddy current by the external magnetic field to the electrode in an electron gun of various cathode ray tubes such as a direct vision type cathode ray tube and the like.

It is noted that the invention is not limited to the above-mentioned arrangement and to the arrangements of the embodiments described later and is variously modified without departing from the technological concepts of the invention.

What is claimed is:

1. A cathode ray tube, comprising a vacuum envelope comprising:

a panel portion forming a phosphor screen, a neck portion housing an electron gun and a funnel portion connecting the panel portion and the neck portion; wherein the electron gun having a plurality of electrodes including a cathode, a control electrode, an accelerating electrode, a focusing electrode to which a focus voltage is applied, and an anode electrode, which are fixed to an insulating support at predetermined intervals and in arranged order along the tube axis;

the focusing electrode comprising a cylindrical electrode and a plate electrode having an electron beam passage which are fixed to an insulating support at predetermined intervals and in arranged order along the tube axis;

the focusing electrode comprising a first cylindrical focusing electrode and a second cylindrical focusing electrode, said plate electrode disposed between said first cylindrical focusing electrode and said second cylindrical electrode; and the cylindrical electrode and the plate electrode being connected at equal potential by a connecting line.

2. The cathode ray tube according to claim 1, wherein the cathode, the control electrode, the accelerating electrode, a second accelerating electrode, the focusing electrode, and the anode electrode, which is electrically connected to the second focusing electrode, are disposed in this order.

3. The cathode ray tube according to claim 1, wherein the first cylindrical focusing electrode is disposed at the cathode side and the second cylindrical focusing electrode is disposed at the phosphor screen side.

4. The cathode ray tube according to claim 1, wherein the second cylindrical focusing electrode has a large diameter portion on the phosphor screen side, and the large diameter portion is inserted to the inside of the anode electrode.

5. The cathode ray tube according to claim 1, wherein a plurality of plate focusing electrodes are disposed between the first cylindrical focusing electrode and the second cylindrical focusing electrode.

6. A cathode ray tube, comprising a vacuum envelope comprising:

a panel portion forming a phosphor screen, a neck portion housing an electron gun and a funnel portion connecting the panel portion and the neck portion; wherein the electron gun having a plurality of electrodes including a cathode, a control electrode, an accelerating electrode, a focusing electrode to which a focus voltage is applied, and an anode electrode, which are fixed to an insulating support at predetermined intervals and in arranged order along the tube axis;

the focusing electrode comprising a cylindrical electrode and a ringed electrode or cup-like electrode, which are fixed to an insulating support at predetermined intervals and in arranged order along the tube axis;

the focusing electrode comprising a first cylindrical focusing electrode and a second cylindrical focusing electrode, said plate electrode disposed between said first cylindrical focusing electrode and said second cylindrical electrode; and the cylindrical electrode and the ringed electrode or cup-like electrode being connected at equal potential by a connecting line.

7. The cathode ray tube according to claim 6, wherein the cathode, the control electrode, the accelerating electrode, a second accelerating electrode, the focusing electrode, and the anode electrode, which is electrically connected to the second accelerating electrode, composing the electron gun are disposed in this order.

8. The cathode ray tube according to claim 7, wherein the first cylindrical focusing electrode is disposed at the cathode side and the second cylindrical focusing electrode is disposed at the phosphor screen side.

9. The cathode ray tube according to claim 8, wherein the second cylindrical focusing electrode has a large diameter portion on the phosphor screen side, and the large diameter portion is inserted to the inside of the anode electrode.

10. The cathode ray tube according to claim 7, wherein a plurality of the ringed electrodes or cup-like electrodes are disposed between the first cylindrical focusing electrode and the second cylindrical focusing electrode.

11. A cathode ray tube, comprising a vacuum envelope comprising a panel portion forming a phosphor screen, a neck portion housing an electron gun and a funnel portion connecting the panel portion and the neck portion; wherein the electron gun having a plurality of electrodes including a cathode, a control electrode, an accelerating electrode, a focusing electrode and an anode electrode which are fixed to an insulating support at predetermined intervals;

the focusing electrode comprising a first cylindrical focusing electode and second cylindrical focusing electrode; and the first cylindrical focusing electrode is disposed at the cathode side and the second cylindrical focusing electrode is disposed at the phosphor screen side; and the length of the first cylindrical focusing electrode in the tube axial direction is set at 4 mm to 8 mm.

12. The cathode ray tube according to claim 11, wherein the cathode, the control electrode, the accelerating electrode, the focusing electrode and the anode electrode are disposed in this order along the tube axis.

13. The cathode ray tube according to claim 11, wherein a plate electrode having an electron beame passage is disposed between the first cylindrical focusing electrode and the second cylindrical focusing electrode.

14. The cathode ray tube according to claim 13, wherein a plurality of plate electrodes are disposed between the first cylindrical focusing electrode and the second cylindrical focusing electrode.

15. The cathode ray tube according to claim 13, wherein the first cylindrical focusing electrode, second cylindrical focusing electrode and the plate electrode are electrically connected by connecting line.

16. The cathode ray tube according to claim 11, wherein the first and second cylindrical electrodes are electrically connected at equal potential by a spiral connecting line surrounding the passage of the electron beam.

17. A cathode ray tube comprising:

a vacuum envelope comprising a panel portion forming a phosphor screen, a neck portion housing an electron gun and a funnel portion connecting the panel portion and the neck portion; wherein a deflecting yoke externally mounted at the transition area of the funnel portion and the neck portion;

a velocity modulating coil externally mounted at the neck portion;

the electron gun having a plurality of electrodes including a cathode, a control electrode, a first accelerating electrode, a second accelerating electrode, a focusing electrode, and an anode electrode which is electrically connected to the second accelerating electrode, said electrodes disposed at predetermined intervals in the tube axial direction;

electrode supports provided at the side wall of each electrode is embedded in and fixed to an insulating support;

the focusing electrode comprising a first cylindrical focusing electrode which is disposed on the cathode side, a second cylindrical focusing electrode which is disposed on the phosphor screen side, and at least one plate electrode which is disposed between the first cylindrical focusing electrode and the second cylindrical focusing electrode, which are fixed to an insulating support at predetermined intervals and in arranged order along the tube axis; and the first cylindrical focusing electrode, the second cylindrical focusing electrode, and the plate electrode are connected at equal potential by a connecting line.

* * * * *